United States Patent [19]

Helms et al.

[11] Patent Number: 4,458,453

[45] Date of Patent: Jul. 10, 1984

[54] ROTARY TOOL AND FLUID MOTOR

[76] Inventors: Hosea W. Helms, 7451 Richmond Pl., St. Louis, Mo. 63143; William J. Brown, 11350 Inverness La., St. Ann, Mo. 63074

[21] Appl. No.: 334,739

[22] Filed: Dec. 28, 1981

[51] Int. Cl.[3] ..... B24B 23/00; F01C 1/00

[52] U.S. Cl. ..... 51/170 PT; 418/177; 51/375

[58] Field of Search ..... 51/170 PT, 170 R, 134.5 F, 51/372, 206 R, 375, 381; 415/503; 15/24; 29/81 J, DIG. 68; 418/177

[56] References Cited

U.S. PATENT DOCUMENTS

| | | | |
|---|---|---|---|
| 1,568,429 | 1/1926 | Tyler | 418/177 |
| 2,548,923 | 4/1951 | Walters et al. | 51/170 PT |
| 2,554,763 | 5/1951 | Wickman | 51/170 R |
| 2,732,671 | 1/1956 | McFadden | 51/170 PT |
| 3,395,495 | 8/1968 | Powanda | 51/170 PT |
| 3,468,073 | 9/1969 | Del Vecchio | 51/170 PT |
| 3,510,989 | 5/1970 | Tolle | 51/170 PT |
| 3,596,411 | 8/1971 | Hutchins | 51/170 PT |
| 3,597,883 | 8/1971 | Choplin | 51/170 PT |
| 3,648,413 | 3/1972 | Godwin et al. | 51/170 PT |
| 3,914,905 | 10/1975 | Waters | 51/170 PT |

FOREIGN PATENT DOCUMENTS

| | | | |
|---|---|---|---|
| 385995 | 1/1933 | United Kingdom | 51/375 |

*Primary Examiner*—Roscoe V. Parker

*Attorney, Agent, or Firm*—Polster, Polster and Lucchesi

[57] ABSTRACT

A rotary tool driving an abrasive member about a rotational axis is disclosed. The tool includes a fluid motor comprising an inner stator assembly having a longitudinal stator body and trunnions extending generally axially endwise from the stator body, the trunnions being eccentrically offset from the central longitudinal axis of the stator body. One of the trunnions having an inlet passage and the other an outlet passage. Bearings are carried by the trunnions and a rotor assembly is journaled on the bearings and is rotatable about the inner stator assembly. The outer rotor assembly includes a rotor body having a generally cylindrical bore therein for reception of the eccentric stator body when the stator assembly is journaled on the bearings concentric with the trunnions. The cylindric bore and the eccentric rotor body define an eccentric space therebetween. The stator body has at least one inlet opening therein for providing communication between the inlet passage and the outer surface of the stator body and at least one exhaust opening therein providing communication between the outer surface of the stator body and the outlet passage. The inlet and outlet ports are angularly offset with respect to one another on the stator body whereby upon holding the stator assembly against rotation and upon introducing pressurized air into the inlet passage, the pressurized fluid flows out of the inlet openings into the eccentric space thereby to forceably, rotatably drive the rotor assembly relative to the stator assembly. The abrasive member is carried on the outside of the outer stator body.

11 Claims, 7 Drawing Figures

ROTARY TOOL AND FLUID MOTOR

BACKGROUND OF THE INVENTION

This invention relates to a rotary abrasive tool and more particularly to a rotary abrasive tool driven by a fluid motor, such as a sliding vane pneumatic motor. Even more specifically, this invention relates to a rotary pneumatic motor in which the outer portions of the motor rotate while the inner portions are held stationary and to such a motor on which an abrasive member may be readily mounted on the outer rotatable surface of the motor.

More specifically, this invention relates to rotary abrasive or abrading tools which have a cylindrical abrasive member rotary about its longitudinal axis with its outer cylindric surface being engageable with the work so as to abrade, clean, grind, brush or sand the work. Generally, these prior art rotary abrasive tools can be divided into two classes. First, those with an integral motor, such as a fluid powered motor. However, these prior art integral motor abrasive tools were generally not compact in size or required relatively expensive air turbine motors or the like. Reference may be had to U.S. Pat. Nos. 2,548,923 and 2,732,671 for prior art rotary abrasive tools with integral motors.

The second class of prior art rotary abrasive tool utilizes a separate electric or air driven motor which is operatively connected to the abrasive member for rotating the latter by means of a belt drive or the like. Of course, because of the offset motor and the belt drive, these prior art abrasive tools were relatively bulky or heavy, and therefore hard to handle, especially when it was desired to manually move the abrasive member over the surface of the work (e.g., over the surface of an automobile body or the like). Reference may be had to the following U.S. Pat. Nos. which disclose various types of prior art rotary abrasive tools with offset motors: 2,554,763, 3,395,495, 3,468,073, 3,510,989, 3,596,411, 3,597,883, 3,648,413, and 3,914,905.

SUMMARY OF THE INVENTION

Among the several objects and features of the present invention may be noted the provision of a rotary abrasive tool and a pneumatic motor therefor which is of lightweight and simple construction and which is of a compact size thereby enabling a workman to readily manually manipulate the rotary tool as the tool is applied to the surface of the work;

The provision of such a rotary abrasive tool and a motor in which an outer elongate, cylindric surface of the motor rotates about a stationary inner stator assembly;

The provision of such a motor which has relatively good torque and horsepower output characteristics, but yet which does not consume unacceptable flow rates of pressurized air;

The provision of such a motor for an abrasive tool or the like which is entirely contained within the confines of an abrasive tool;

The provision of such a rotary abrasive tool and a motor which is reliable in operation; and The provision of such an abrasive tool in which the abrasive member may readily be placed thereon, which is positively held in place against rotation, and yet which may be readily exchanged.

Other objects and features of this invention will be in part apparent and in part pointed out hereinafter.

Briefly stated, a tool of the present invention is adapted to rotatably drive an abrasive member about a rotation axis. The tool includes a pneumatic motor, the latter comprising an inner stator assembly having a longitudinal stator body and trunnions extending generally axially endwise from each end of the stator body. The trunnions are eccentrically offset from the central longitudinal axis of the stator body with one of the trunnions having a passage therein extending axially into the stator body and constituting an inlet passage for pressurized fluid and the other of the trunnions having a passage therein extending axially from the stator body and constituting an outlet passage for low pressure fluid to be exhausted. Bearing means carried by the trunnions are provided within the motor. An outer rotor assembly is journaled on the bearings and is rotatable about the inner stator assembly. The outer rotor assembly includes a rotor body having a generally cylindric bore therewithin for reception of the eccentric stator body when the stator assembly is journaled on the bearings concentric with the trunnions. The cylindric bore and the eccentric rotor body define an eccentric space therebetween. The rotor body has a plurality of sliding vanes mounted therein for radial sliding movement relative to the stator body and spring means is provided for resiliently biasing the inner ends of the sliding vanes into sliding, sealing engagement with the stator body. The latter further has at least one inlet opening therein providing communication between the inlet passage and the outer surface of the stator body and at least one exhaust opening therein providing communication between the outer surface of the stator body and the outlet passage. The inlet and outlet openings are angularly offset with respect to one another on the stator body whereby upon holding the stator assembly against rotation and upon introducing pressurized fluid into the inlet passage, the pressurized fluid flows out of the inlet openings into the eccentric space thereby to forceably drive the rotor assembly relative to the stator assembly. In addition, means is provided for removably mounting the abrasive member on the outer surface of the rotor body.

The improvement of the present invention also includes the pneumatic motor per se, as generally is set forth above.

BRIEF DESCRIPTION OF THE DRAWINGS

Corresponding reference characters indicate corresponding parts throughout the several views of the drawings.

DESCRIPTION OF PREFERRED EMBODIMENTS

Figure 3:
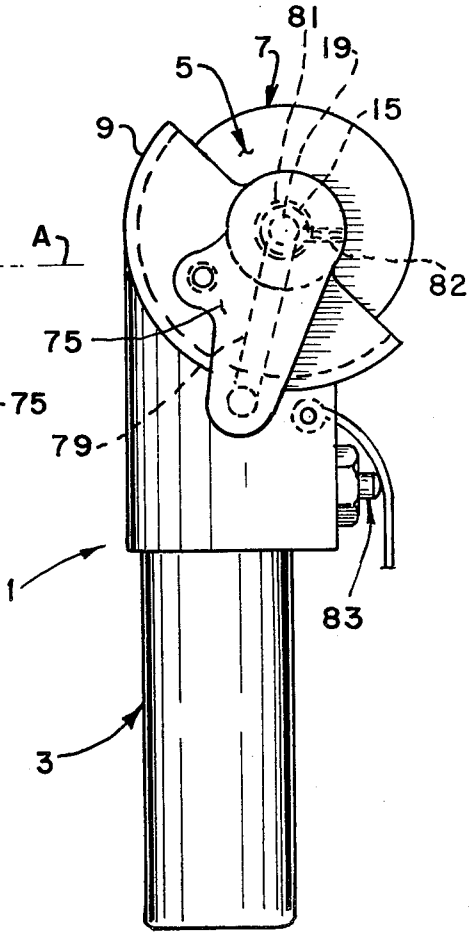
FIG. 3 is a right side elevational view of the tool shown in FIG. 1.
Figure 1:
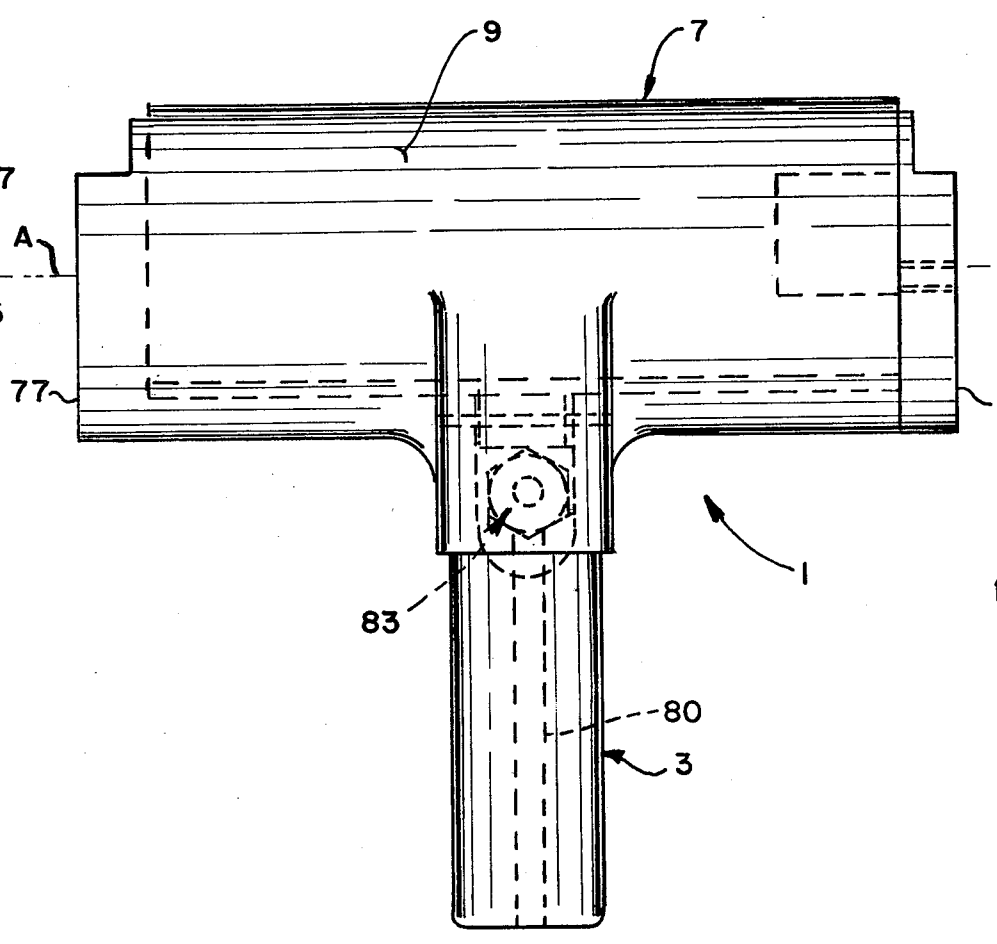
FIG. 1 is a top plan view of a rotary abrasive tool of the present invention.
Figure 2:
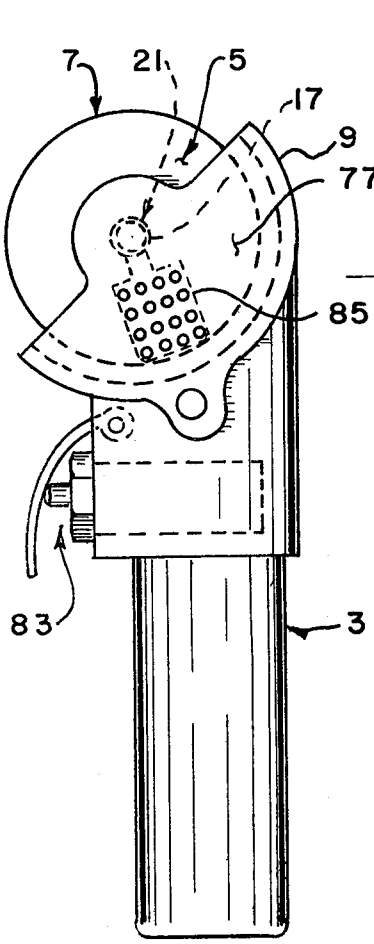
FIG. 2 is a left side elevational view of the tool shown in FIG. 1.

Referring now to the drawings and specifically to FIGS. 1-3, a pressurized fluid or pneumatic abrasive tool of the present invention is indicated in its entirety by reference character 1. The tool includes a handle 3 carrying a pneumatic motor 5 thereon with a portion of the motor being rotatable about a longitudinal rotational axis A—A extending generally from one side to the other of handle 3. On the outer cylindrical surface of motor 5, an abrasive member 7 is mounted for operatively engaging the work. Handle 3 further includes a guard 9 which at least partially surrounds the ends and the portion of abrasive member 7 toward the operator. A portion of the rotary abrasive member is exposed for operative engagement with the work.

Referring now to FIGS. 4-7, pneumatic motor 5 will now be described in detail. The motor includes an inner stator assembly, as generally indicated at 11, including a stator body 13. The stator body is generally an elongate, cylindrical member having a respective trunnion 15 or 17 extending endwise from each end thereof. Each of these trunnions is eccentrically offset from the cylindrical axis of stator body 13, and are coaxial with axis A—A. Trunnion 15 has a blind bore 19 coaxial therewithin extending inwardly of the trunnion into the interior of stator body 13 and thus constitutes an inlet passage for the admittance of pressurized fluid (e.g., pressurized air). Trunnion 17 at the other end of the stator body likewise has a blind bore 21 extending axially into the trunnion and into the stator body and this other blind bore constitutes an outlet passage.

Motor 5 further includes a rotor assembly, as generally indicated at 23, mounted on the exterior of stator assembly 11. The rotor assembly includes a rotor body 25 of generally elongate, cylindrical construction. The rotor body includes an outer tube 27 and an inner rotor body 29 disposed on the inside of outer tube 27 and secured thereto. The inner face of inner rotor body 29 is so shaped as to define an inner cylindrical bore 31 for rotor body 25. A plurality of radial slots 33*a*-33*d* (see FIG. 5) are provided in inner motor body 29. A respective axial vane 35*a*-35*d* is slidably received in each of the slots 33*a*-33*d* and the axial vanes are free to slide radially inwardly and outwardly relative to inner rotor body 29 within their respective slots. A respective compression leaf spring 37*a*-37*d* is received in each of the slots 33*a*-33*d* and is in engagement with the outer edge of its respective axial vane 35*a*-35*d* thereby to resiliently bias the axial vanes radially inwardly for slidably, sealably engaging the outer cylindric surface of the cylindric stator body 13.

Figure 4:
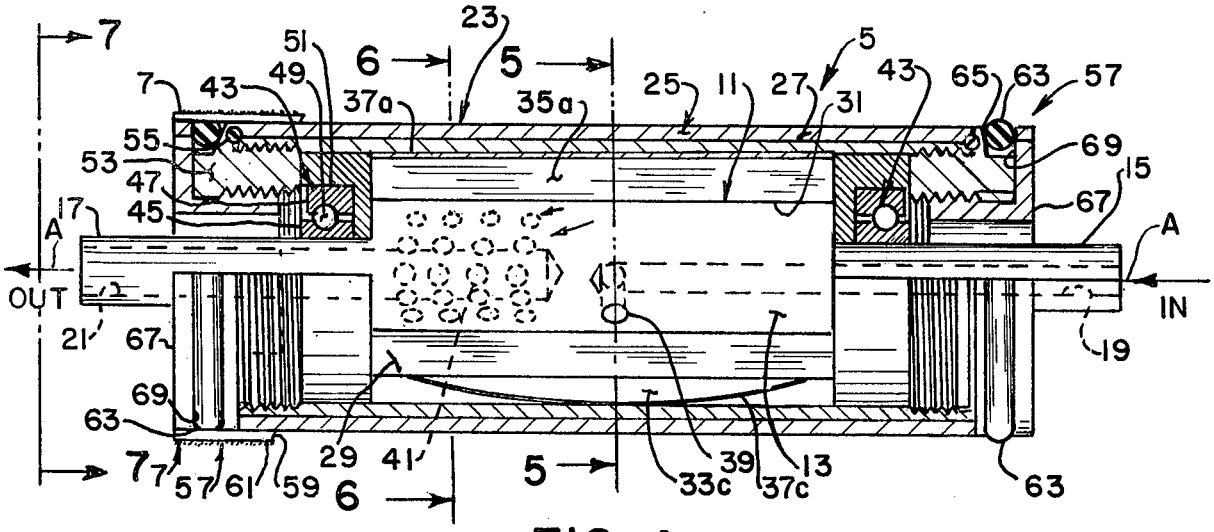
FIG. 4 is a longitudinal cross-sectional view of the sliding vane fluid motor of the present invention as it is incorporated in the tool shown in FIGS. 1-3 with parts of the motor broken away for purposes of clarity.

In accordance with this invention, stator body 13 is provided with at least one inlet opening 39 between the outer face of the stator body and inlet passage 19 so as to permit pressurized fluid (e.g., pressurized air) to flow from the inlet passage to the outer surface of the stator body. Further, a plurality of outlet openings 41 is provided in the stator body 13 so as to provide communication from the exterior of the stator body into outlet passage 21 whereby low pressure fluid, after having expended its potential energy to rotatably drive rotor assembly 23 relative to the stator assembly, may be exhausted to the atmosphere via outlet passage 21. As shown in FIG. 4, two inlet openings 39 are provided in stator body 13 adjacent one end of the stator body (e.g., the end adjacent trunnion 15 and inlet passage 19). At least one, and preferably a multiplicity of (e.g., twenty) outlet openings 41 are provided in the stator body at the other end thereof adjacent trunnion 17. Further in accordance with this invention, it will be noted in FIGS. 5 and 6 that outlet passages or openings 41 are angularly offset relative to inlet openings 39 by approximately the angle included between a pair of adjacent sliding vanes 35*a*, 35*b*. Preferably, the included angle between the inlet and outlet openings may be somewhat more than the angle between adjacent vanes. As shown in FIG. 6, outlet openings 41 are arranged in an array which spans an arc on stator body 13 preferably ranging between about 90°-130°. However, the angular spacing between the inlet and outlet openings may be varied considerably within the broader aspects of this invention. For example, with four vanes provided in the stator assembly as indicated in FIGS. 5 and 6, the included angle between the vanes is approximately 90° whereas the included angle between the inlet and the first of the outlet openings may be about 100°.

Figure 5:
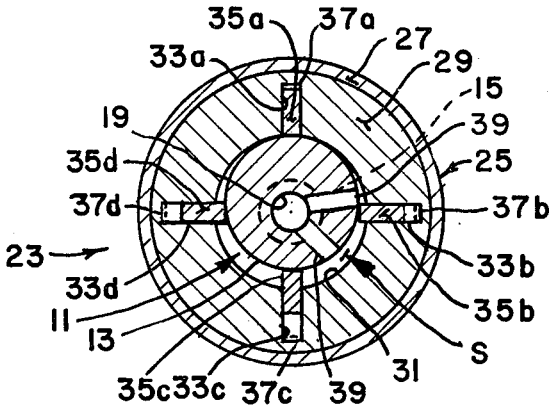
FIG. 5 is a diametric cross-sectional view of the fluid motor shown in FIG. 4 taken along line 5—5 of FIG. 4.
Figure 6:
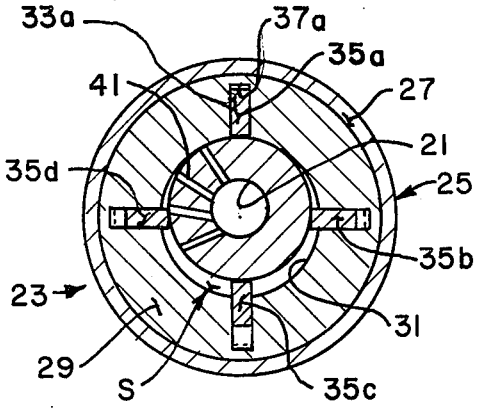
FIG. 6 is a view similar to FIG. 5 taken along line 6—6 of FIG. 4.
Figure 7:
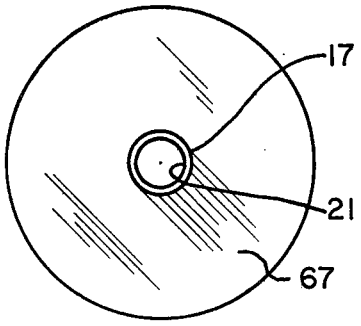
FIG. 7 is a left end elevational view taken along line 7—7 of FIG. 4 illustrating the end of the motor.

As noted, the inner face of the rotor body 29 forms an inner cylindrical bore 31, the diameter of this inner bore being substantially larger than the diameter of stator body 13 whereby the stator body, mounted eccentrically on trunnions 17 and 19, is received within bore 31 with a portion of the stator body in close proximity to the inner bore of the inner rotor body (at its top as shown in FIGS. 5 and 6) thereby defining an eccentric space S between inner cylindrical bore 31 of rotor body 25 and the outer cylindric surface of stator body 13. It will be understood that as pressurized fluid (e.g., compressed gas or a liquid under pressure) is admitted into eccentric space S via inlet openings 39 in stator body 13, the fluid will tend to exert a pressure force on the inner face (i.e., the face toward inlet openings 39) of axial vanes 35*a*-35*d* as the rotor assembly 23 rotates relative to the stator assembly 11. This pressure force on the faces of the axial vanes tends to rotate rotor assembly 23 in clockwise direction (as viewed in FIGS. 5 and 6) with respect to the stationary stator assembly 11. As the relatively high pressure fluid behind one of the sliding vanes (e.g., vane 35*c*) rotates past the last inlet opening 39 and into communication with outlet openings 41 (as shown in FIG. 6), the pressurized fluid within space S begins to be vented to the atmosphere via outlet openings 41 and via outlet passage 21. It will be appreciated that the portion of space S between adjacent sliding vanes 35*c* and 35*d* (FIG. 6) is exposed to any one of the plurality of outlet openings 41 for a considerable angle as the outer rotor assembly rotates about the inner stator assembly thereby to insure that a large portion of the fluid (compressed air) contained in the portion of the eccentric space between axial vanes 35*c* and 35*d* is exhausted to the atmosphere whereby the fluid pressure in this portion of the eccentric space S is essentially atmospheric pressure.

In accordance with this invention, the direction of rotation of the fluid motor 5 may be reversed from that described above by admitted pressurized fluid into the motor via passage 21 and by exhausting fluid from the motor via passage 19. Those skilled in the art will appreciate that by designing a tool with air passages leading to each trunnion passage 19 or 21 and by providing an air selector switch, the direction of rotation of motor 5 may be readily reversed.

Each of the trunnions 15 and 17 carries a respective bearing assembly 43 for journaling rotor assembly 23 with respect to stator assembly 11. Each of these bearings 43 includes an inner race 45 received on its respective trunnion 15 or 17, an outer race 47, and a plurality of rolling bearing elements 49 between the inner and outer races for rotatably supporting the outer race relative to the inner race.

Again referring to FIG. 4, bearings 43 are held in place within rotor assembly 23 by means of the inner races 45 of the bearings each being pressed onto the outer surfaces of their respective trunnions 15 and 17. Likewise, outer races 47 of the bearings are press fit in the bore of a cup 51 which fits in the outer end of outer tube 27 of rotor body 25. Outer tube 27 has internal threads in its ends. A collar 53 is also threaded into the outer end of outer tube 27 and an O-ring seal 55 is provided between a flange on collar 53 and the outer end of tube 27 thereby to seal the rotor assembly relative to the stator assembly. It will be further understood that the press fit between cup 51 and trunnions 15 and 17 is a leak tight fit thereby to prevent the leakage of compressed air or other pressurized fluid from space S between the rotor and the stator bodies to the atmosphere.

In accordance with this invention, means, as generally indicated at 57, is provided for frictionally holding abrasive member 7 on rotor body 25. Specifically, abrasive member 7 is shown to be a disposable member having a tubular body 59 adapted to receive rotor body 25. The abrasive member further includes a suitable abrasive surface 61 on the outer surface of tubular body 57. It will be understood that abrasive member 7 is intended to be a disposable abrasive member which, after it has given significant wear, may be removed from tool 1 of this invention, discarded, and replaced with a new abrasive member. It will further be understood that while the use of a tubular body abrasive member, as described above, may be perferred, it would be possible to utilize a sheet-abrasive member which is wrapped around the outer surface of rotor body 25 and which is held in place by suitable means in a manner well-known to those skilled in the abrasive field. One example of a suitable holding arrangement for sheet-abrasive material which may be utilized in conjunction with the present invention is presently found on drum-type floor sanders or the like.

Referring now to FIG. 4, means 57 at each end of rotor body 25 is shown to comprise an elastomeric ring 63. As is shown in the drawings, the outer diameter of this ring 63 is sized to be somewhat larger than the outer diameter of rotor body 25, and yet is slightly smaller than the inner diameter of tubular body 59 of abrasive member 7. In this manner, it will be understood that tubular body 59 of the abrasive member may be readily slid on to rotor body 25 clear of elastomeric ring 63. Collar 53 is shown to have a beveled face 65 which bears against the inner face of the elastomeric ring. A cap 67 is threaded into the inner bore of collar 53. Cap 67 is shown to have an inwardly facing shoulder 69 which is adapted to engage the outer face of ring 63 so that as the cap is threaded into collar 53, the elastomeric ring 63 is compressed between beveled face 65 and shoulder 69 thereby to compress the elastomeric ring therebetween and to cause the ring to expand outwardly in radial direction thereby to engage the inner face of tubular body 59 so as to hold abrasive member 7 in a fixed rotational position relative to rotor body 25 and to also prevent axial movement of the abrasive tool relative to the rotor body. In this manner, the abrasive member is frictionally held in position on the rotor body.

To remove a worn out abrasive member 7 and to replace it by another, one need merely loosen caps 67 thereby to permit the elastomeric rings 63 to relax thereby permitting tubular body 59 of the abrasive member to be slid axially off the rotor assembly 23. It will be appreciated that caps 67 need only be loosen and that they need not be removed to permit the removal of one abrasive member and the installation of another. Further, it is intended that caps 67 may be readily tightened and loosened to a desired amount by hand without the necessity of using hand tools thereby to facilitate the quick change of abrasive tools.

Again referring to FIGS. 1–3, the handle/frame assembly 3 of pneumatic tool 1 further includes a pair of spaced apart arms 75 and 77 at the outer end of the frame assembly for receiving and holding pneumatic motor 5. At least one of these arms has suitable quick release means engageable with trunnion 15 or 17 for holding the pneumatic motor in place between arms 75 and 77. It will be understood that arm 75 is provided with an air supply passage 79 to provide communication between inlet passage 19 in trunnion 15 and a supply of compressed fluid (compressed air) supplied to handle 3 by means of an air hose (not shown) connectable to the rear of handle 3. An air passage 80 is provided in the handle, as shown in FIG. 1. Further, arm 75 includes a suitable gland seal 81 so that upon installation of trunnion 15 in the arm, the trunnion is sealed relative to air passage 79 thereby to permit compressed air to enter inlet passage 19 through the handle. A lock screw 82 is carried by arm 75 which, after insertion of trunnion 17 in arm 75, may be turned so as to lock the trunnion in the arm. A suitable control valve 83 is incorporated within air passage 80 in handle 3 so that the operator may selectively control operation of pneumatic motor 5 via passage 79. Further, trunnion 17 is held in place within arm 77 and a suitable muffler 85 is incorporated in arm 77 in communication with outlet passage 21 thereby to muffle the sound of exhaust compressed air discharged through outlet passage 21 in trunnion 17.

In view of the above, it will be seen that the other objects of this invention are achieved and other advantageous results obtained.

As various changes could be made in the above constructions without departing from the scope of the invention, it is intended that all matter contained in the above description or shown in the accompanying drawings shall be interpreted as illustrative and not in a limiting sense.

What is claimed is:

1. An abrasive tool adapted to drive rotatably a cylindric abrasive member about the cylindric axis of said abrasive member, said tool including a pneumatic motor, the latter comprising an inner stator assembly having a stator body and a trunnion extending generally axially endwise from each end of said stator body, one of said trunnions having a passage therein extending axially into said stator body and constituting an inlet passage for pressurized fluid and the other of said trunnions having a blind passage therein extending axially from said stator body and constituting an outlet passage for low pressure fluid to be exhausted therefrom, bearing means carried by said trunnions, an outer rotor assembly journaled on said bearings and being rotatable about said inner stator assembly, said outer rotor assembly including a rotor body having a generally cylindrical bore therein for reception of said stator body when said stator assembly is journaled on said bearings concentric with said trunnions, said cylindric bore and said rotor body defining an eccentric space therebetween, said rotor body having a plurality of sliding vanes mounted therein for radial sliding movement relative to said stator body, and spring means for resiliently biasing the inner ends of said sliding vane into sliding, sealing engagement with said stator body, said spring means comprising a plurality of leaf springs, one for each of said vanes, said springs being disposed between said rotor body and the outer end of each respective vane for resiliently biasing said vane inwardly toward the outer surface of said stator body so as to maintain said vane in sliding, sealing contact with said stator body, said stator body having at least one inlet opening therein providing communication between said inlet passage and the outer surface of said stator body and at least one exhaust opening therein providing communication between the outer surface of said stator body and said outlet passage, said inlet and outlet openings being angularly offset with respect to one another on said stator body whereby upon holding said stator assembly against rotation and upon introducing pressurized fluid into said inlet passage, the pressurized fluid flows out of said inlet opening into said eccentric space thereby to forceably drive said rotor assembly relative to said stator assembly.

2. An abrasive tool as set forth in claim 1 wherein said abrasive member is a tubular member and is received on the outside of said rotor body, and wherein said abrasive tool further includes means at each end of said rotor body for frictionally gripping said tubular abrasive member thereby to substantially prevent relative movement between said abrasive member and said rotor body.

3. An abrasive tool as set forth in claim 2 wherein said gripping means comprises an elastomeric member at each end of said rotor body and means for expanding said elastic member radially outwardly thereby to engage and grip the inner surface of said tubular abrasive member.

4. An abrasive tool as set forth in claim 3 wherein said elastomeric member is a ring having an outer diameter somewhat less than the inner diameter of said tubular abrasive member, and wherein each of said gripping means comprises a compression member threaded on said motor for axially inward and outward movement relative to said motor, said compression member and said rotor body having surfaces thereon between which said ring is disposed so that upon threading said compression member inwardly toward said rotor body, said elastomeric ring is compressed therebetween and is forced radially outwardly into gripping engagement with the inner surface of said tubular abrasive member.

5. An abrasive tool as set forth in claim 1 further comprising a handle assembly in which said pneumatic motor is mounted, said handle having portions thereof engageable with said trunnions for removably securing said motor in place within said handle, said motor being readily removable from said handle so as to permit the ready changing of one abrasive member with another.

6. An abrasive tool as set forth in claim 5 wherein at least one of said handle portions includes selectively operable means engageable with a respective said trunnion for locking said trunnion within said handle portion.

7. A sliding vane fluid motor comprising an inner stator assembly having a stator body and a trunnion extending generally axially endwise from each end of said stator body, one of said trunnions having a passage therein extending axially into said stator body and constituting an inlet passage for pressurized fluid and the other of said trunnions having a passage therein extending axially from said stator body and constituting an outlet passage for fluid to be exhausted therefrom, bearing means carried by said trunnions, an outer rotor assembly journaled on said bearings and being rotatable about said inner stator assembly, said outer rotor assembly including a rotor body having a generally cylindrical bore therein for reception of said stator body when said stator assembly is journaled on said bearings concentric with said trunnions, said rotor body cylindric bore and said stator body defining an eccentric space therebetween, said rotor body having a plurality of sliding vanes mounted therein for radial sliding movement relative to said stator body, and spring means for resiliently biasing the inner ends of said sliding vanes into sliding, sealing engagement with said stator body, said spring means comprising a plurality of leaf springs, one for each of said vanes, said springs being disposed between said rotor body and the outer end of each respective vane for resiliently biasing said vane inwardly toward the outer surface of said stator body so as to maintain said vane in sliding, sealing contact with said stator body, said stator body having at least one inlet opening therein providing communication between said inlet passage and the outer surface of said stator body and at least one exhaust opening therein providing communication between the outer surface of said stator body and said outlet passage, said inlet and outlet openings being angularly offset with respect to one another on said stator body whereby upon holding said stator assembly against rotation and upon introducing pressurized fluid into said inlet passage, the pressurized fluid flows out of said inlet opening into said eccentric space thereby to forceably drive said rotor assembly relative to said stator assembly.

8. A motor as set forth in claim 7 wherein said rotor body includes means for removably mounting a disposable abrasive member on the outer surface thereof for doing work as said rotor body is rotated relative to said stator assembly.

9. A motor as set forth in claim 8 wherein said rotor body has a generally cylindrical outer surface and wherein said abrasive member is a tubular member having an opening therethrough for reception of said rotor body, said motor further having means at each end of said rotor body for frictionally gripping said abrasive member thereby to prevent relative movement between said abrasive member and said rotor body.

10. A motor as set forth in claim 9 wherein said gripping means comprises an elastomeric member at each end of said rotor body and means for expanding said elastic member radially outwardly thereby to engage and grip the inner surface of said abrasive member.

11. A motor as set forth in claim 10 wherein said elastic member is an O-ring having an outer diameter somewhat less than the inner diameter of said tubular abrasive member, and wherein each of said gripping means comprises a compression member threaded on said motor for axially inward and outward movement relative to said motor, said compression member and said rotor body having surfaces thereon between which said ring is disposed so that upon threading said compression member inwardly toward said rotor body said O-ring is compressed therebetween and is forced radially outwardly into gripping engagement with the inner surface of said tubular abrasive member.

* * * * *